United States Patent [19]

Kobayashi

[11] Patent Number: 5,028,041

[45] Date of Patent: Jul. 2, 1991

[54] IMAGE FORMING APPARATUS WITH SHEET FEEDER

[75] Inventor: Hiroo Kobayashi, Tokyo, Japan

[73] Assignee: Canon Kabushiki Kaisha, Tokyo, Japan

[21] Appl. No.: 300,239

[22] Filed: Jan. 23, 1989

Related U.S. Application Data

[63] Continuation of Ser. No. 47,516, May 6, 1987, abandoned, which is a continuation of Ser. No. 790,169, Oct. 22, 1985, abandoned.

[30] Foreign Application Priority Data

Oct. 26, 1984 [JP] Japan ..... 59-226539
Oct. 26, 1984 [JP] Japan ..... 59-226540

[51] Int. Cl.[5] ..... B65H 5/26

[52] U.S. Cl. ..... 271/9; 271/263; 271/258; 271/265

[58] Field of Search ..... 271/9, 10, 127, 160, 271/170, 171, 145, 263, 256, 258, 259, 265, 157, 3.1; 221/6; 355/3 SH, 14 SH

[56] References Cited

U.S. PATENT DOCUMENTS

| | | | |
|---|---|---|---|
| 3,260,402 | 7/1966 | Lareau et al. | 221/6 |
| 3,854,713 | 12/1974 | Kohda | 271/3.1 |
| 3,918,704 | 11/1975 | Sugiyama et al. | 271/263 |
| 4,021,032 | 5/1977 | Gross et al. | 271/259 X |
| 4,265,440 | 5/1981 | Shibazaki et al. | 271/9 |
| 4,347,924 | 9/1982 | Hayashi et al. | 133/2 X |
| 4,386,769 | 6/1983 | Ito et al. | 271/9 |
| 4,449,705 | 5/1984 | Shibuya et al. | 271/9 |
| 4,469,320 | 9/1984 | Wenthe, Jr. | 271/3.1 X |
| 4,484,734 | 11/1984 | Tsudaka et al. | 271/9 |
| 4,589,645 | 5/1986 | Tracy | 271/3.1 |

FOREIGN PATENT DOCUMENTS

| | | | |
|---|---|---|---|
| 0019981 | 2/1983 | Japan | 271/9 |
| 0031834 | 2/1983 | Japan | 271/9 |
| 0130838 | 8/1983 | Japan | 271/9 |
| 0188244 | 9/1985 | Japan | 271/9 |
| 0188245 | 9/1985 | Japan | 271/9 |
| 61-32218 | 7/1986 | Japan . | |
| 61-32220 | 7/1986 | Japan . | |

*Primary Examiner*—David H. Bollinger
*Attorney, Agent, or Firm*—Fitzpatrick, Cella, Harper & Scinto

[57] ABSTRACT

An image forming apparatus uses a sheet feeder wherein sheets of paper are picked-up and fed one-by-one from a stack of sheets stacked on a tray. A sensor is provided to detect that the amount of sheets remaining on the stack reaches a predetermined level which corresponds to a small amount of sheets. The sensor produces a prewarning signal which indicates a low supply of sheets on the stack, although not empty to the operator. Or, when a plurality of sheet stacking trays or cassettes are used, the sheet feeding is switched so as to be carried out from another sheet stacking tray. The problems that occur when the paper supply is low can be avoided.

21 Claims, 8 Drawing Sheets

IMAGE FORMING APPARATUS WITH SHEET FEEDER

This application is a continuation of application Ser. No. 07/047,516, filed May 6, 1987, now abandoned which was a continuation of Ser. No. 06/990,169, filed Oct. 22, 1985, also abandoned.

FIELD OF THE INVENTION AND RELATED ART

The present invention relates to an image forming apparatus with a sheet feeder, more particularly to an image forming apparatus which is provided with a sheet stacking means such as a cassette and with feeding means for feeding the sheets contained in the sheet stacking means.

It is conventional that the image forming apparatus of this type is equipped with a reflective type and transparent type photosensor or the like in order to detect the remaining sheets in the cassette or deck. The photosensor or the like detects only whether or not there is any sheet. Therefore, all of the sheets are fed out of the cassette or deck.

Recently, the image forming apparatus has become used not only by itself, but also together with convenient peripheral equipment such as an automatic document feeder and/or a sorter, and therefore, the efficiency of printing or copying operation have been increased. When a large number of printed copies are produced with such equipment, the user or operator is usually absent from the place where the apparatus is located because the printing operation is automatically continued with the equipment. And, he will return to the place about the time when the printing operation is expected to finish. On such an occasion, if the number of sheets in the cassette or deck was not enough, the apparatus stops its printing operation at the instance when the sheets were used up; and therefore, the operator would be disappointed when he returns.

A laser beam printer or the like provided with such a cassette or deck has recently become used widely as a message receiving device of a facsimile system. The facsimile must receive messages during the night (no operator) as well as during day time. If there are no sheets in the cassette or the deck, the facsimile machine fails to receive any message.

On the other hand, when the remaining number of sheets in the cassette or deck is very small, particularly when only one sheet remains, the sheet feeding fails most frequency. Stated another way, the sheet frequently jams, or plural sheets are fed out at a time when few sheets remain in the cassette or deck. The cause of this is considered as being imbalance between the frictional coefficient between adjacent sheets and a frictional coefficient between the transfer sheet and the surface of the cassette or deck contacted thereto, which is easily influenced by ambient conditions such as the temperature and moisture. This problem has not been solved completely.

SUMMARY OF THE INVENTION

Accordingly, it is a principal object of the present invention to provide an image forming apparatus with a sheet feeder, wherein the problems which result from using the sheets up are avoided.

In order to accomplish the object, the image recording apparatus according to an embodiment of the present invention comprises sheet stacking means for stacking sheet materials, feeding means for feeding the sheet materials out of the stack and detecting means for detecting that the remaining amount of the sheet materials reaches a predetermined level.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
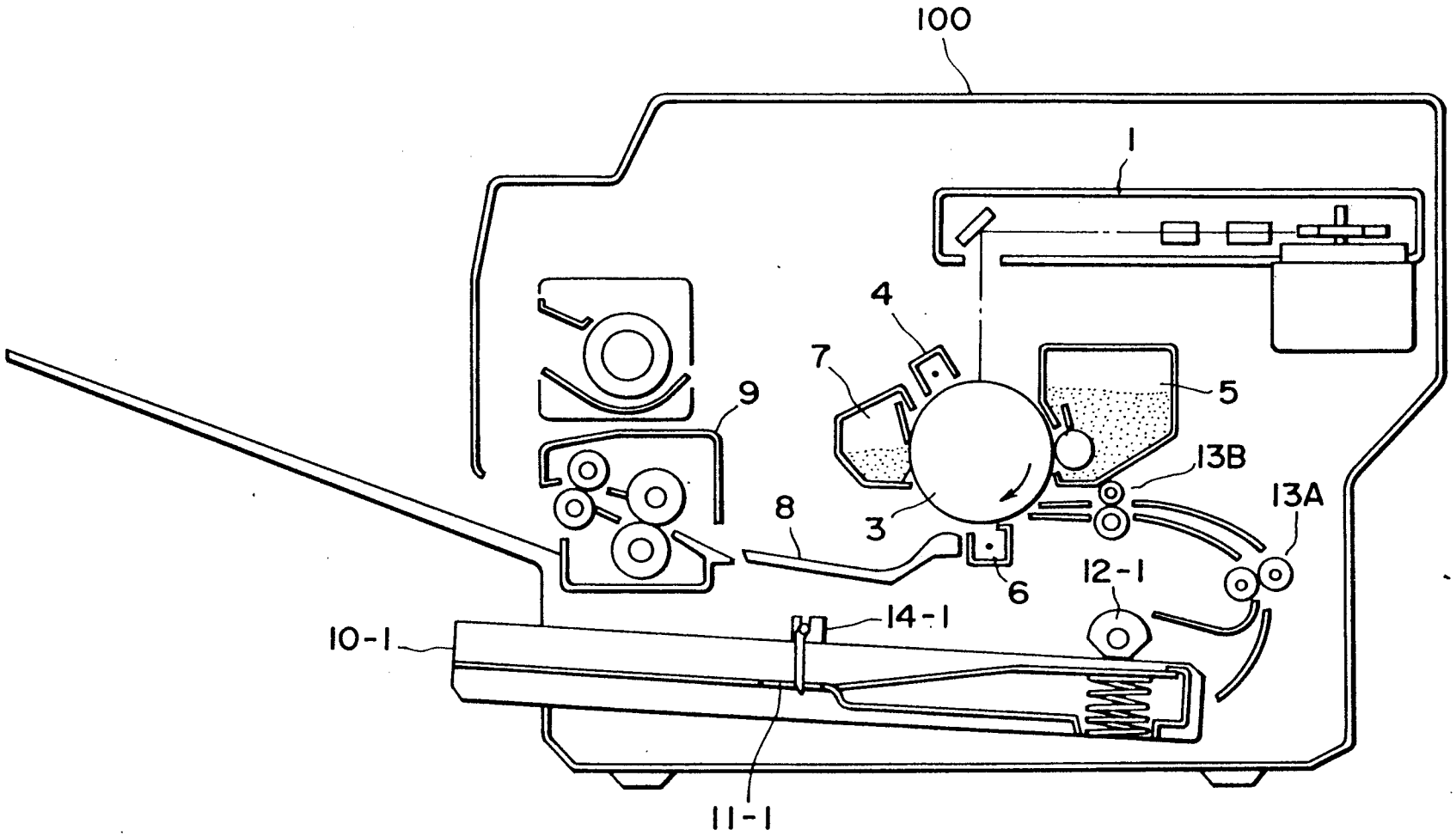
FIG. 1 is a sectional view of an image forming apparatus according to an embodiment of the present invention.

Referring to FIG. 1, there is shown an image forming apparatus according to an embodiment of the present invention which is a laser beam printer in this embodiment. The apparatus comprises at the top part thereof a scanning optical unit 1 including a scanner motor, a polygonal mirror, a lens, mirrors and so on, which are known. In the middle of the apparatus, there is a photosensitive member 3 in the form of a rotatable cylinder. Around the photosensitive member 3, there are provided a charger 4, developing device 5, a transfer charger 6, a cleaning device 7 and so on.

In operation, the surface of the photosensitive member 3 is uniformly charged by the charger 4 and then exposed to image light projected through the scanning optical unit 1 so that an electrostatic latent image is formed thereon. Then, the latent image is developed into a visualized image by the developing device 5. On the other hand, a transfer sheet P is picked up from a cassette 10-1 by a pick-up roller 12-1 and is fed by feeding rollers 13A and 13B to the surface of the photosensitive member 3 at an image transfer station, where the visualized image is transferred onto the transfer sheet P by the transfer charger 6. Thereafter, the transfer sheet P is separated from the photosensitive member 3 by an separating means (not shown) and then conveyed to an image fixing device 9 along a guide 8. By the fixing device 9, the toner image on the transfer sheet P is fixed into a permanent image, and then discharged out of the image forming apparatus. The toner remaining on the photosensitive member 3 without being transferred onto the transfer sheet, is corrected by the cleaning device 7. At a bottom portion of the apparatus, there is provided a remaining amount detecting device 14-1 for detecting the remaining amount of the transfer sheets in the cassette 10-1, at such a position as corresponds to the cassette 10-1.

Figure 2:
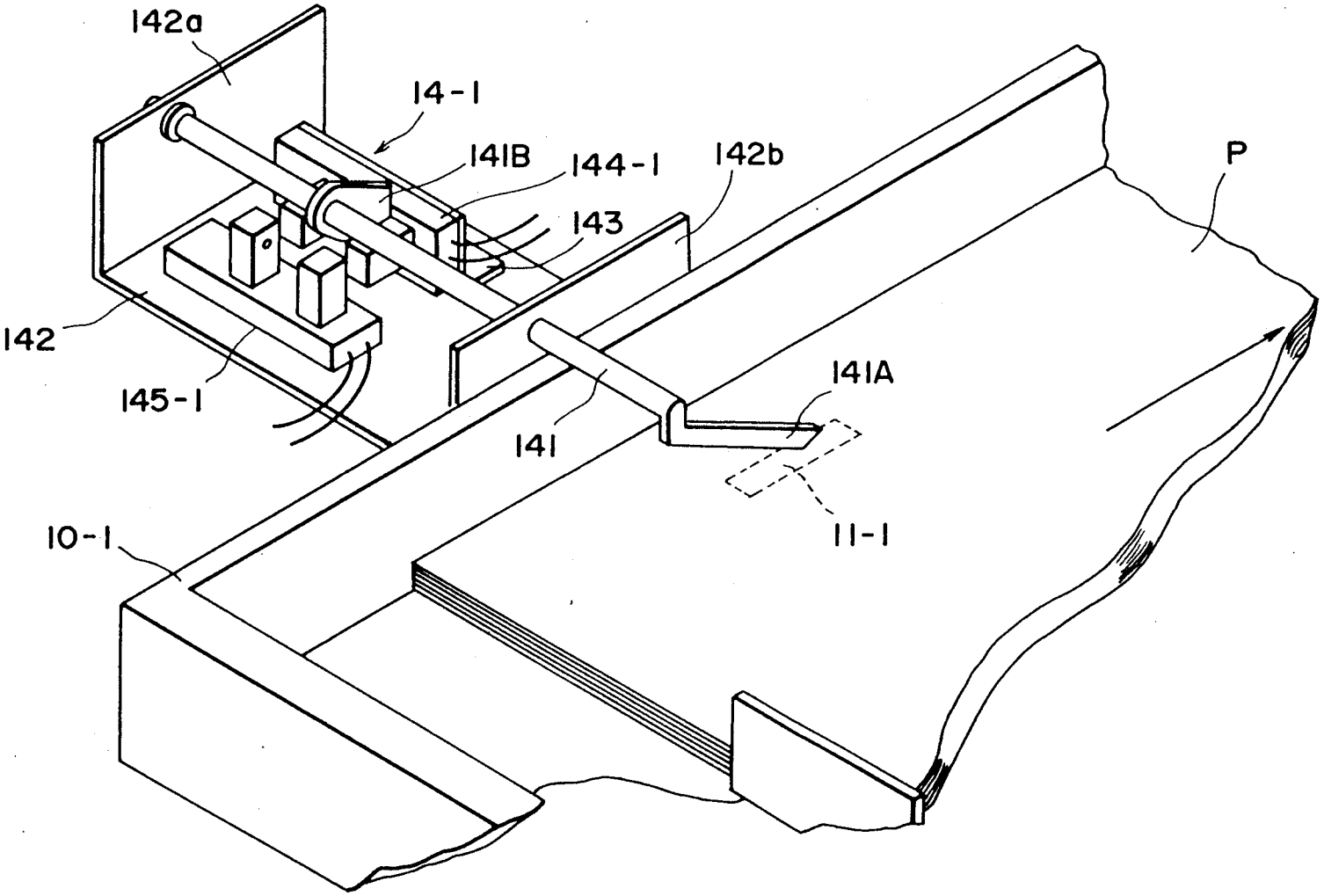
FIG. 2 is a perspective view of a part of a cassette used with the apparatus of FIG. 1, illustrating a prewarning device.
Figure 3A:
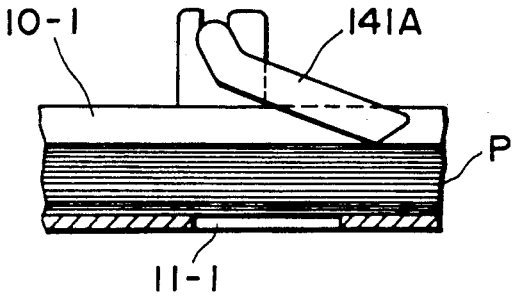
FIGS. 3A, 3B, 4A, 4B, 5A and 5B are sectional views illustrating the operation of the prewarning device.
Figure 3B:
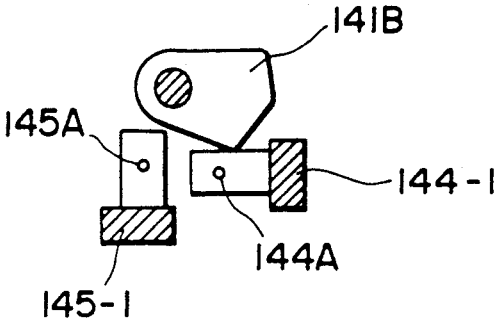
Figure 4A:
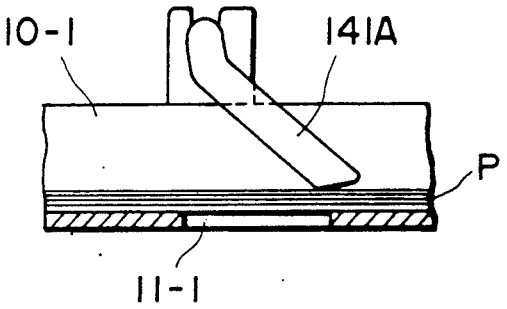
Figure 4B:
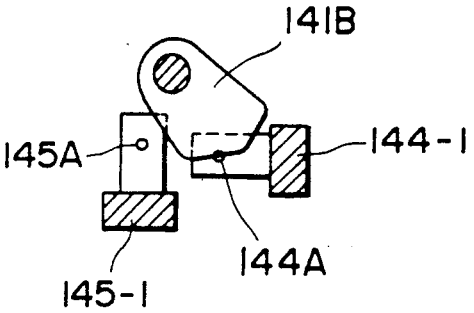
Figure 5A:
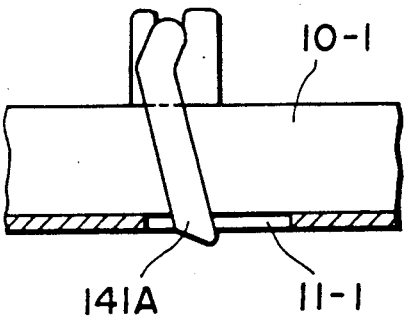
Figure 5B:
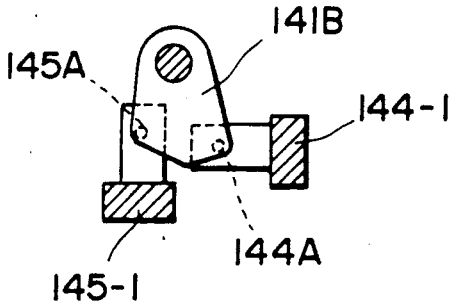

The remaining amount detecting device 14-1, as shown in FIG. 2, includes a frame 142 having side plates 142*a* and 142*b*, through which an arm shaft 141 is rotatably mounted. An arm 141A is fixed to or is formed integrally with the arm 141 at an end of the arm shaft 141. A light blocking plate 141B is fixed to the arm shaft 141 adjacent the middle thereof. Below the shaft 141 adjacent to the light blocking plate 141B, there are provided two photosensors 144-1 and 145-1. The photosensor 144-1 is a transparent type photosensor for prewarning absence of the sheet, while the photosensor 145-1 is a transparent type photosensor for detecting the absence of the sheet. The light blocking plate 141B and the photosensors 144-1 and 145-1 are so related that the light blocking plate 141B can be brought with rotation of the arm shaft 141 into the optical paths in the respective photosensors 144-1 and 145-1. In the bottom plate of the cassette 10-1, a through aperture 11-1 is formed so as to allow the arm 141A to rotate further beyond the bottom.

The operation of the remaining amount detecting device 14-1 will be described in conjunction with FIGS. 3A, 3B, 4A, 4B, 5A, 5B and 6. When there is abundant sheets P in the cassette 10-1 (FIG. 3A), the arm 141A takes the rightwardly rotated position, so that the light blocking plate 141B fixed on the arm 141 does not shut the sensing window 144A of the prewarning sensor 144-1 (FIG. 3B), and therefore, the printing operation of the image forming apparatus can be performed or continued.

In this state, the light emitted from light emitting diodes D1-1 and D2-2 reaches associated transistors T1-1 and T2-1, respectively, with the result of a loop current indicated by ①, wherefor light emitting diodes L1-1 and L2-2 are not lit.

With continued printing operation, the amount of the transfer sheets P decreases gradually, and accordingly, the arm 141A moves down by clockwise rotation thereof. Upon the remaining amount reaching a predetermined or preset level (FIG. 4A), the light blocking plate 141B fixed on the shaft 141 shuts the sensing window 144A of the prewarning sensor 144-1 (FIG. 4B), whereupon a signal is produced to turn on the light emitting diode L1-1 in FIG. 6, thus effecting the prewarning. In response thereto, the operator replenishes the cassette 10-1 with the transfer sheet, and then the mechanism goes back to the state shown in FIGS. 3A and 3B. If the operator does not replenish the cassette in response to the prewarning, the printing operation continues until all the transfer sheets are used up. If this occurs, the arm 141A takes its bottommost position where it is inserted into the aperture 11-1 (FIG. 5A), whereupon the light blocking plate 141B shuts the sensing window 145A of the no-sheet detecting sensor 145-1 (FIG. 5B), so that a signal is produced to turn on the light emitting diode L2-1 of FIG. 6 to produce a no-sheet indication. In the circuit shown in FIG. 6, the light emitting diode L1-1 or L2-1 is turned on when the light emitted from the light emitting diode D1-1 or D2-1 is blocked and is not transmitted to the transistor T1-1 or T2-1 so that the loop current indicated by ① flows.

According to this embodiment, directed to an image forming apparatus equipped with a cassette or deck, the prewarning device is provided with respect to the cassette or deck so that the state in which a small amount of the transfer sheets are remained therein is detected, and a signal is produced to make an indication. Because of this, the operator is informed of the fact that only a small amount of sheets remains in the cassette or deck, thereby enabling the operator to replenish the cassette or deck with the transfer sheets if he wants to print further, with the result that the above-described failures can be avoided beforehand. In the case when the prewarning device is used with the receiver part of a facsimile machine, the above indication is effective to enable the operator to supply transfer sheets before reaching the absence thereof. Therefore, a situation can be avoided in which the message receiving operation suddenly fails due to the absence of a transfer sheet. This is most effective when the image forming apparatus or the facsimile machine is operated without any person attending thereto, for example, during the night (it is not possible to supply the transfer sheets).

Figure 7:
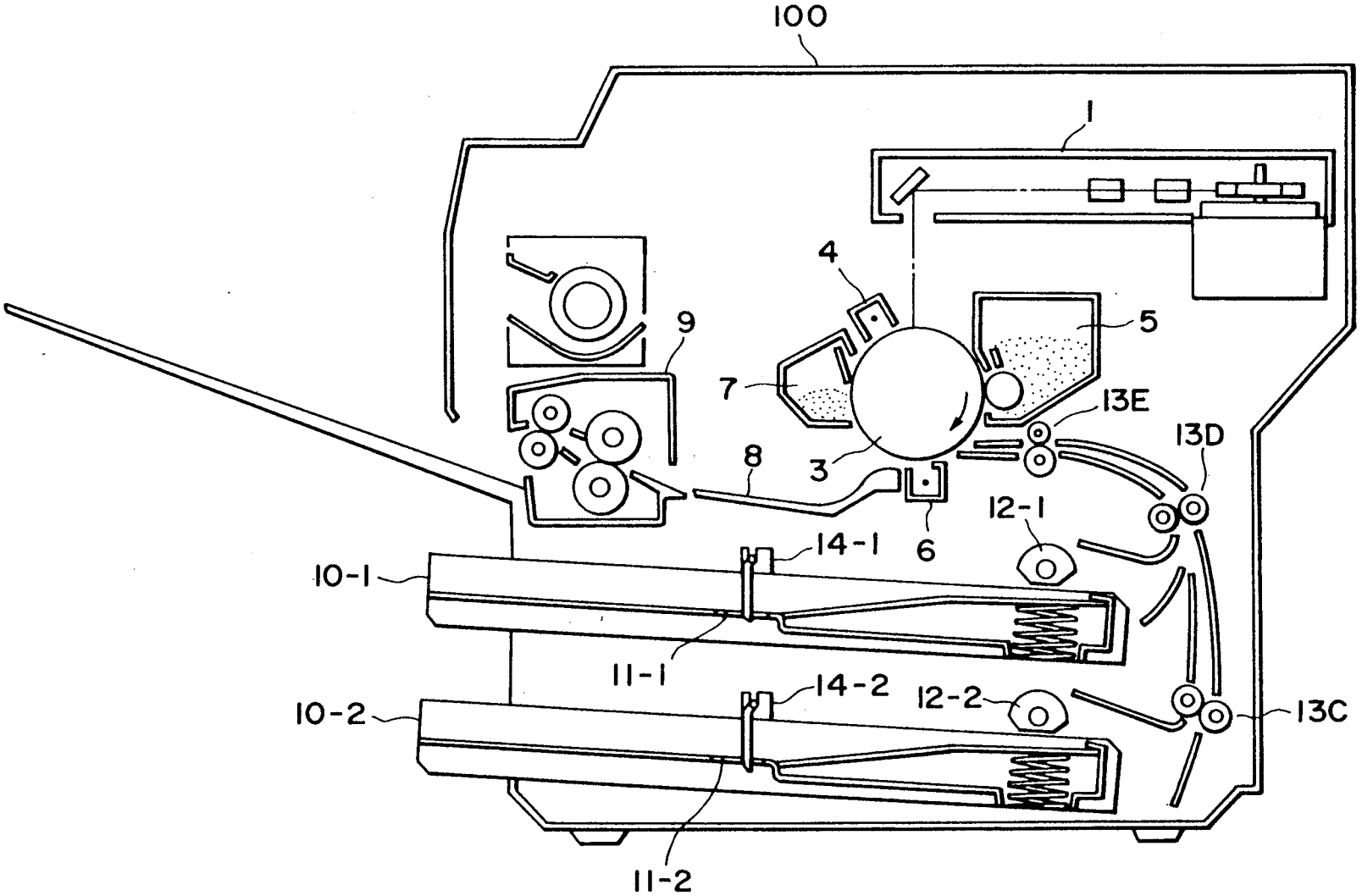
FIG. 7 is a sectional view of an image forming apparatus according to another embodiment of the present invention.

FIG. 7 illustrates a laser beam printer according to another embodiment of the present invention. Since this embodiment is similar to the first embodiment with the exception of those which will be described hereinafter, the detailed explanation of the similar parts is omitted for the sake of simplicity by assigning the same reference numerals to the corresponding elements. In the present embodiment, there are provided plural, two in this embodiment, cassettes 10-1 and 10-2, each of which is provided with the sheet remaining amount detecting device 14-1 or 14-2 and the sheet feeding means 12-1 or 12-2. Each of the detecting devices 14-1 and 14-2 has the same structure as described with FIG. 2. In this embodiment, the cassette are vertically aligned, and therefore, they are called an upper cassette and a lower cassette. In the following description, the various elements associated with the upper cassette are assigned by reference numerals added by "−1", while those associated with the lower cassette are assigned reference numerals added by "−2".

The operation of the remaining amount detecting device 14-1 will be described in conjunction with FIGS. 3A, 3B, 4A, 4B, 5A, 5B and 6. When there is abundant sheets P in the cassette 10-1 (FIG. 3A), the arm 141A takes the rightwardly rotated position, so that the light blocking plate 141B fixed on the arm 141 does not shut the sensing window 144A of the prewarning sensor 144-1 (FIG. 3B), and therefore, the printing operation of the image forming apparatus can be performed or continued.

Figure 6:
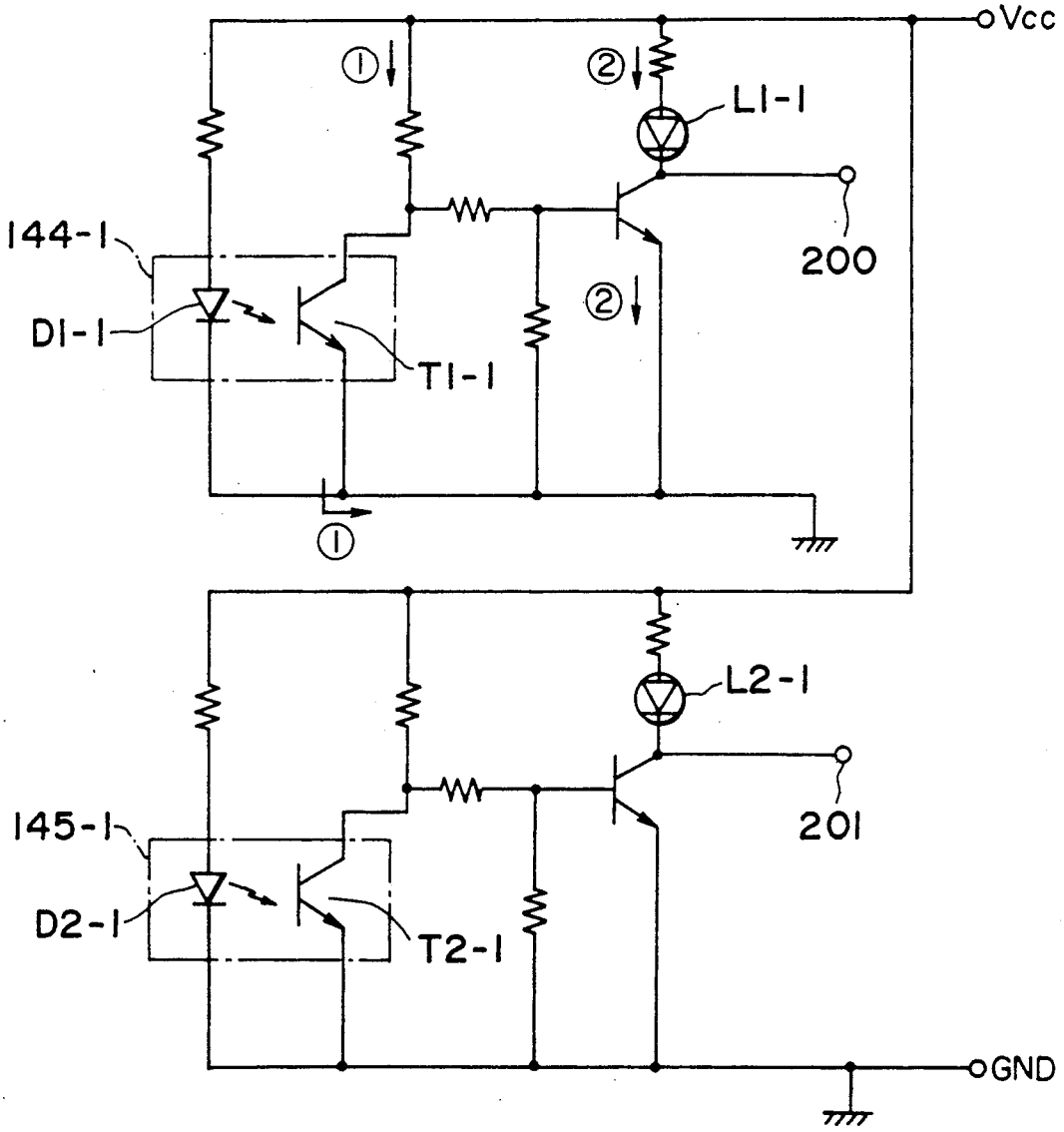
FIG. 6 is a circuit diagram of a sensor used with the prewarning device shown in FIG. 2.

In this state, the light emitted from light emitting diodes D1-1 and D2-2 reaches associated transistors T1-1 and T2-1, respectively, with the result of a loop current indicated by ①, wherefor light emitting diodes L1-1 and L2-2 are not lit, as shown in FIG. 6. The sensors 144-2 and 145-2 have the similar structure.

With continued printing operation, the amount of the transfer sheets P decreases gradually, and accordingly, the arm 141A moves down by clockwise rotation thereof. Upon the remaining amount reaching a predetermined or preset level (FIG. 4A), the light blocking plate 141B fixed on the shaft 141 shuts the sensing window 144A of the prewarning sensor 144-1 (FIG. 4B), whereupon a signal is produced to turn on the light emitting diode L1-1 in FIG. 6, thus effecting the prewarning. On the other hand, in response to this signal, the sheet feeding operation is switched to the lower cassette 10-2, and the feeding roller 12-2 starts rotating.

When this switching takes place, the actual switching operation is not instantaneously responsive, in this embodiment, to the signal since the length of the transport path from the lower cassette 10-2 to the transfer station is longer than that from the upper cassette 10-1. For example, after the signal is produced, one sheet is fed further from the same, i.e., the upper cassette 10-1, while simultaneously the feeding from the lower cassette 10-2 is being made ready. By doing so, the continuous printing operation is not interrupted. This is particularly preferable in the case of high speed printing or in the case that the printing is effected on small size transfer sheets.

When the printing operation is continued without exchanging the cassette (for example, when the lower cassette does not contain any sheet), the upper cassette will become vacant sooner or later. If this occurs, the arm 141A takes its bottommost position where it is inserted into the aperture 11-1 (FIG. 5A), whereupon the light blocking plate 141B shuts the sensing window 145A of the no-sheet detecting sensor 145-1 (FIG. 5B), so that a signal is produced to turn on the light emitting diode L2-1 of FIG. 6 to produce a no-sheet indication. In the circuit shown in FIG. 6, the light emitting diode L1-1 or L2-1 is turned on when the light emitted from the light emitting diode D1-1 or D2-1 is blocked and is not transmitted to the transistor T1-1 or T2-1 so that the loop current indicated by ② flows. With respect to the lower cassette 10-2, the light emitting diodes L1-2 and L2-2 are arranged and operated in the similar manner.

Figure 8:
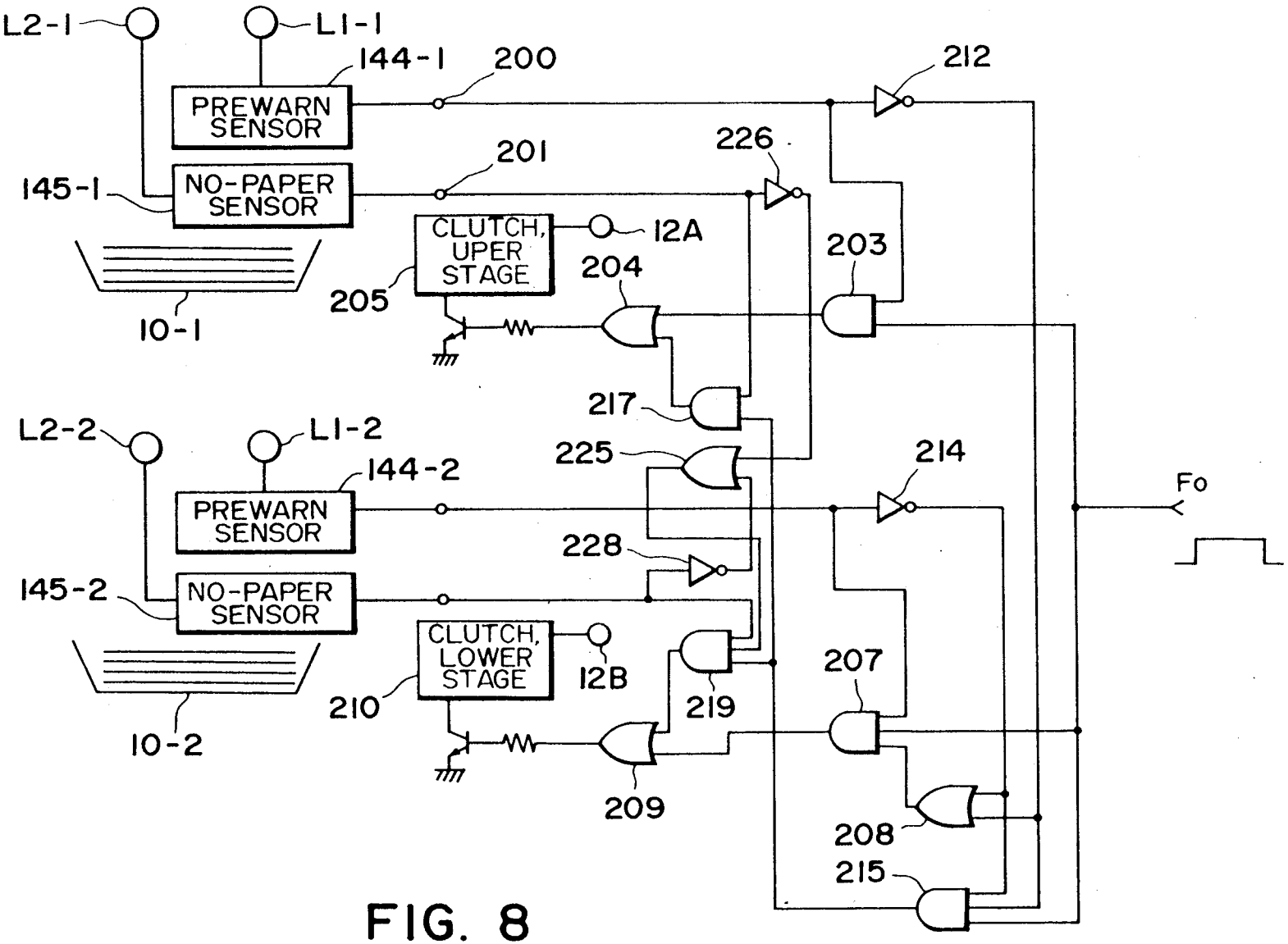
FIG. 8 is a circuit diagram used for exchanging the cassettes.

FIG. 8 shows a circuit for effecting the switching of the cassettes.

(I) When the cassette 10-1 and 10-2 contain abundant sheets, and a sheet feeding signal $F_0$ is generated:

Since the input terminals of an AND circuit 203 are at a high level (H), and therefore, one of the input terminals of an OR circuit 204 is at high level (H), so that a sheet feeding clutch 205 is energized to provide an output at 12A to rotate the sheet feeding roller 12-1. On the other hand, one of the inputs to an AND circuit 207 is connected to an output of an OR circuit 208, whereby the output of the AND circuit is at low level (L), with the result that the input of an OR circuit 209 is at low level (L). Therefore, the sheet feeding clutch 210 is not energized, so that the sheet feeding roller 12-2 does not rotate.

With the continued operation, the amount of sheets remaining in the cassette 10-1 decreases, to such an extent that it reaches the predetermined level, whereupon the prewarning sensor 144-1 is actuated to produce a sheet feeding signal $F_0$. In response thereto, one of the inputs of the OR circuit 208 is changed to a high level (H) through an inverter 212, and therfore, all of the three inputs to the AND circuit 207 become high level (H). As a result, one of the inputs to the OR circuit 209 becomes high (H), so that the sheet feeding clutch 210 is energized to provide an output at 2B to rotate the sheet feeding roller 12-2. On the other hand, one of the inputs to the AND circuit 203 becomes low (L), and therefore, the output of the AND circuit 203 becomes low (L), while the output of the OR circuit 204 is switched to the low level (L). As a result, the power supply to the sheet feeding clutch 205 is stopped so that the sheet feeding roller 12-1 stops.

With further continued operation, the amount of sheets in the cassette 10-2 decreases, to such an extend that it reaches the predetermined level, in response to which the prewarning sensor 144-2 operates, to that one of the inputs of the AND circuit 207 becomes low (L), and that the output of the AND circuit 207 becomes low (L), with the result that the output of the OR circuit 209 becomes low (L) so as to stop the sheet feeding roller 12-2. On the other hand, one of the inputs of the AND circuit 215 becomes high (H) through the inverter 214, whereby the output of the AND circuit 215 is inverted to high (H) upon generation of the feeding signal $F_0$. Therefore, the input of the AND circuit 217 becomes high (H), and the output thereof becomes high (H). Consequently, the output of the OR circuit 204 becomes high (H), so as to rotate the sheet feeding roller 12-1.

(II) When the sheet feeding signal $F_0$ is generated without the cassette 10-2 loaded in the apparatus or with the prewarning sensor 144-2 or no-sheet sensor 145-2 actuated:

The input of the AND circuit 219 connected to the no-sheet sensor 145-2 is at low level (L), and the input of the AND circuit 207 connected to the prewarning sensor 144-2 is also at the low level (L). Therefore, the outputs of the AND circuits 219 and 207 are low (L), so that the sheet feeding roller 12-2 does not rotate.

If the sheets are continuously fed out from the cassette 10-1 until the remaining amount reaches the predetermined level, the prewarning sensor 144-1 operates. Then, one of the inputs of the AND circuit 203 becomes low (L), and the output thereof becomes low (L), too. When the sheet feeding signal $F_0$ is generated, all of the inputs to the AND circuit 215 become high (H) so as to bring the output thereof to high (H). As a consequence, the inputs to the AND circuit 217 become high (H) so that the output thereof becomes high (H), and therefore, the output of the OR circuit 204 becomes high (H) so as to continue the sheet feeding clutch 205 to be connected with power to allow the sheet feeding roller 12-1 to rotate continuously.

With the continued operation, all of the sheets in the cassette 10-1 are used up so that no-sheet sensor 145-1 is actuated, with the result that one of the inputs to the AND circuit 217 becomes low to bring the output of the AND circuit 217 to the low level (L). Accordingly, the output of the OR circuit 204 becomes low (L) so as to stop the sheet feeding roller 12-1.

(III) When the prewarning sensors 144-1 and 144-2 for the cassettes 10-1 and 10-2 are both actuated:

When the sheet feeding signal $F_0$ is produced, the output of the AND circuit 215 becomes high (H), and the output of the AND circuit 217 becomes high (H), too. Therefore, the output of the OR circuit 204 becomes high (H) to rotate the sheet feeding roller 12-1. At this time, the output of the OR circuit 225 is at the low level (L), and the output of the AND circuit 219 is at the low level (L), too. Additionally, the output of the AND circuit 207 is at the low level (L). Therefore, the sheet feeding roller 12-2 does not rotate.

When the sheets in the cassette 10-1 are consumed up, one of the inputs to the OR circuit 225 becomes high (H) through the inverter 226 so that the output of the OR circuit 225 becomes high (H). When the sheet feeding signal $F_0$ is produced, all of the inputs to the AND circuit 219 becomes high (H), and the output of the OR circuit 209 becomes high (H) so as to rotate the sheet feeding roller 12-2. Of course, the sheet feeding roller 12-1 stops at this time.

Sooner or later, there becomes no sheet in the cassette 10-2 so that the no-sheet sensor 145-2 actuates so as to stop the sheet feeding roller 12-2.

According to this embodiment of the image forming apparatus provided with two or more cassettes or decks wherein upon one of the cassettes or decks becoming empty, the other or another cassette or deck is used by an automatic switching. And, the switching is carried out while a small amount of sheets still remains in the first cassette on the basis of the detection thereof by the prewarning sensor. By doing so, the possible superposed plural sheets feeding or jamming which may be caused by feeding down to the bottommost sheet, can be avoided whereby a smooth printing operation can be performed.

Conventionally, when the sheet feeding cassette or deck is switched, the switching operation is started upon the detection of no-paper. If the switching is to be effected from the short sheet passage side to the long sheet passage side, that is, from the upper cassette to the lower cassette, in this embodiment, the time required for completing the switching operation does not match the continued printing operation so that the printing operation stops once. This incurs suspicion of an abnormal situation to the operator. According to the present invention, since the signal is produced when a small number of sheets still remain in the cassette or deck, and therefore, one or more transfer sheets are continuously fed therefrom, while completing the switching operation, with the consequence of eliminating the necessity of the interruption. This will accomplish the smooth switching of the printing operation, and simultaneously, this maintains the operator to feel easy upon the switching operation.

When the lower cassette is not loaded in the apparatus and when the prewarning sensor is actuated from the upper cassette, the operator may supply the sheets to the upper cassette. By this, similar to the foregoing embodiments, the inconvenience that a facsimile machine becomes suddenly unable to receive the message because of the absence of paper, can be avoided. The present invention is not limited to the detailed structures of the described embodiment.

For example, in the two embodiments, cassettes or decks have been used, but the present invention is applicable to the case where a cassette or deck is not used, instead, the sheet materials are stacked on a tray.

Figure 9A:
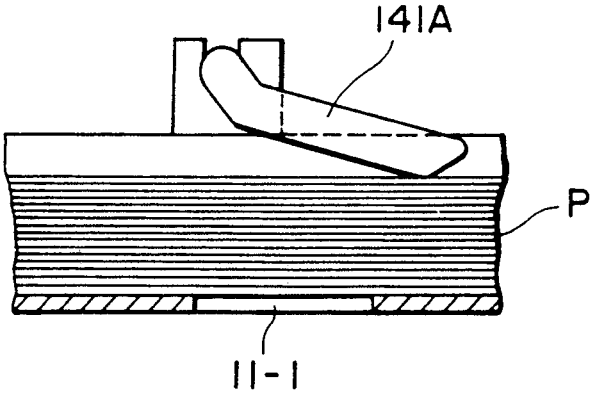
FIGS. 9A and 9B are sectional views illustrating another embodiment of the prewarning device.
Figure 9B:
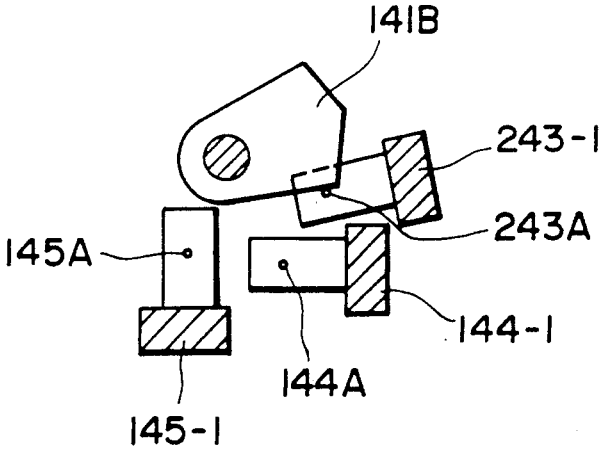
Figure 10:
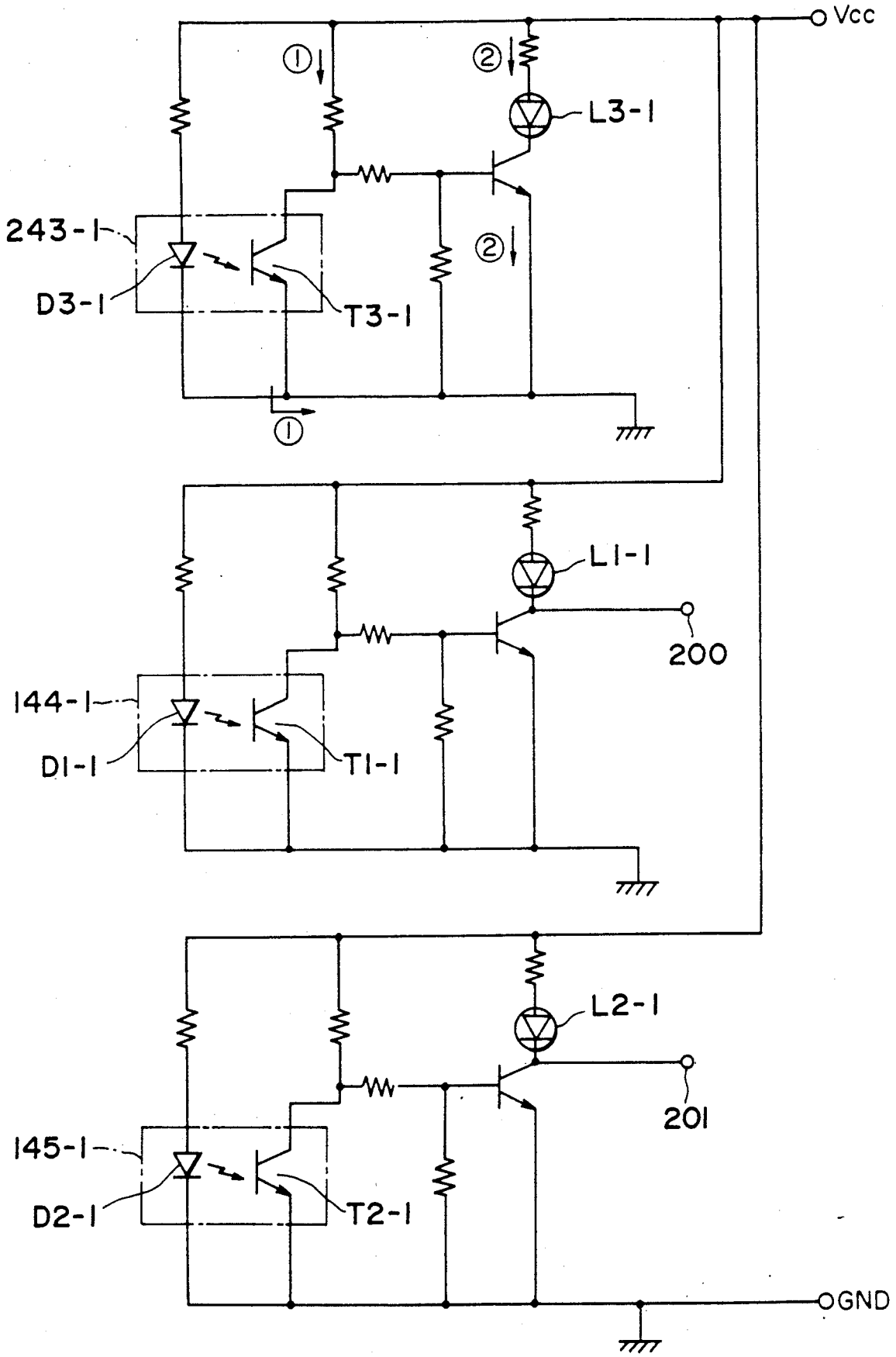
FIG. 10 is a circuit used with the prewarning device of FIG. 9.

As for the prewarning, an additional sensor 243-1 may be additionally employed so as to further prewarn or warn prior to the above-described prewarning, as shown in FIGS. 9A and 9B. In this case, the operator may replenish the cassette when the light emitting diode L3-1 is turned on, or he may replenish it when the light emitting diode L1-1 is turned on. The selection therebetween may be made on the basis of the expected printing operation thereafter. The times of the prewarning may be increased, if desired. FIGS. 9A, 9B and 10 will be readily understood by the one skilled in the art in view of the description of the above two embodiments.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

first and second stacking means for stacking sheet materials to form a first and a second stack of sheet materials;

first and second feeding means for feeding the sheet materials out of said first and second stacks, respectively;

a first contact member in contact with the topmost sheet material of the first stack and movable in accordance with the amount of sheet materials remaining on said first stack;

first detecting means for producing a signal when said first contact member comes to a position corresponding to a first predetermined amount of remaining on said first stack;

second detecting means for producing a signal when said first contact member comes to a position corresponding to a second predetermined amount remaining on said first stack;

a second contact member in contact with the topmost sheet material of the second stack and movable in accordance with the amount of sheet materials remaining on said second stack;

third detecting means for producing a signal when said second contact member comes to a position corresponding to a first predetermined amount remaining on said second stack;

a fourth detecting means for producing a signal when said second contact member comes to a position corresponding to a second predetermined amount remaining on said second stack; and control means for switching sheet material feeding operation from said first stacking means to said second stacking means when receiving the signal from said first detecting means; for switching the sheet material feeding operation from said second stacking means to said first stacking means when receiving the signal from said third detecting means; and for switching the sheet material feeding operation from said first stacking means to said second stacking means when receiving the signal from said second detecting means to allow continuance of the sheet material feeding operation from said second stacking means until the signal from said fourth detecting means is received.

2. An image forming apparatus according to claim 1, wherein the second predetermined amounts remaining on the first and second stacks are zero.

3. An image forming apparatus according to claim 1, wherein said first contact member and said second contact member have rotatable arms.

4. An image forming apparatus according to claim 1, wherein said first, second, third and fourth detecting means have photosensors.

5. A sheet feeding apparatus, comprising:

first and second stacking means for stacking sheet material to form a first and second stack of sheet material;

first feeding means for feeding the sheet material out of said first stack;

second feeding means for feeding the sheet material out of said second stack;

first signal generating means for generating a signal when an amount of the sheet material remaining on said first stacking means reaches a first predetermined level;

second signal generating means for generating a signal when an amount of the sheet material remaining on said first stacking means reaches a second predetermined level which is lower than the first predetermined level;

third signal generating means for generating a signal when an amount of the sheet material remaining on said second stacking means reaches a third predetermined level;

fourth signal generating means for generating a signal when an amount of the sheet material remaining on said second stacking means reaches a fourth predetermined level; and control means for responding to the signal from said first signal generating means to switch sheet material feeding operation from said first feeding means to said second feeding means, for responding to the signal from said third signal generating means to switch the sheet material feeding operation from said second feeding means to said first feeding means, for responding to the signal from said second signal generating means to switch the sheet material feeding operation from said first feeding means to said second feeding means and for continuing the sheet material feeding operation by said second feeding means until said fourth signal generating means generates the signal.

6. An apparatus according to claim 5, wherein at least one of said first and second stacking means includes a cassette for accommodating the sheet material.

7. An apparatus according to claim 5, wherein at least one of said second stacking means includes a deck for accommodating the sheet material.

8. An apparatus according to claim 5, wherein at least one of said first, second, third and fourth signal generating means includes a member contactable to the topmost sheet material of the associated stack and movable in accordance with the height of the stack.

9. An apparatus according to claim 5, wherein at least one of said first, second, third and fourth signal generating means includes a member contactable to the topmost sheet material of the associated stack and movable in accordance with a height of the stack, and a photosensor for producing a signal in response to a predetermined position of said contactable member.

10. An apparatus according to claim 9, wherein said first and second signal generating means has the contactable member common to them.

11. An apparatus according to claim 5, wherein said third and fourth signal generating means has the contactable member common to them.

12. An apparatus according to claim 5, further comprising warning means for producing a warning in response to a signal produced by said first signal generating means.

13. An image forming apparatus, comprising:

first and second stacking means for stacking sheet material to form a first and second stack of sheet material;

first feeding means for feeding the sheet material out of said first stack;

second feeding means for feeding the sheet material out of said second stack;

means for forming images on the sheet material;

a first passage for introducing the sheet material fed by said first feeding means to said image forming means;

a second passage for introducing the sheet material fed by said second feeding means to said image forming means;

wherein the second passage is longer than the first passage;

first signal generating means for generating a first signal when an amount of the sheet material remaining in said first stacking means reaches a first predetermined level which corresponds to one or more sheet materials, and for generating a second signal when the amount of the sheet material remaining in said first stacking means is equal to or greater than a second predetermined level which corresponds to a number of sheets which is greater than,that corresponding to the first predetermined level;

second signal generating means for generating a third signal when an amount of the sheet material remaining in said second stacking means is greater than a third predetermined level;

first control means for prohibiting a feeding operation of said first feeding means in response to the first signal regardless of a sheet feeding signal, and for allowing the feeding operation of said first feeding means in response to the second signal and the sheet feeding signal; and second control means for allowing a feeding operation of said second feeding means in response to the first signal, the third signal, and the sheet feeding signal, and for prohibiting the feeding operation of said second feeding means in response to the second signal regardless of both the third signal, and the sheet feeding signal.

14. An apparatus according to claim 13, wherein said image forming means includes an image bearing member for bearing an image to be transferred onto the sheet material.

15. An apparatus according to claim 14, wherein the image bearing member includes a photosensitive surface on which a latent image is formed by image exposure thereof.

16. A sheet feeding apparatus, comprising:

first and second stacking means for stacking sheet materials to form a first and a second stack of sheet materials;

first feeding means for sequentially feeding the sheet material out of said first stack;

second feeding means for sequentially feeding the sheet material out of said second stack;

first signal generating means for generating a first signal when an amount of the sheet materials remaining in said first stacking means reaches a first predetermined level which corresponds to one or more sheet materials, and for generating a second signal when the amount of the sheet materials remaining in said first stacking means is equal to or greater than a second predetermined level which corresponds to a number of sheets which is greater than that corresponding to the first predetermined level;

second signal generating means for generating a third signal when ana mount of the sheet materials remaining in said second stack is greater than a third predetermined level;

first control means for prohibiting a feeding operation of said first feeding means in response to the first signal regardless of a sheet feeding signal, and for allowing the feeding operation of said first feeding means in response to the second signal and the sheet feeding signal; and second control means for allowing a feeding operation of said second feeding means in response to the first signal, the third signal and the sheet feeding signal, and for prohibiting the feeding operation of said second feeding means in response to the second signal, regardless of the third signal, and the sheet feeding signal.

17. An apparatus according to claim 11, wherein said first signal generating means includes a first contactable member contactable to the topmost sheet material of the first stack and movable in accordance with the height of the stack.

18. An apparatus according to claim 17, wherein said first signal generating means includes a photosensor for producing a first signal in response to a predetermined position of the first contactable member.

19. An apparatus according to claim 16, wherein at least one of said first and second stacking means includes a cassette for accommodating the sheet material.

20. An apparatus according to claim 16, wherein at least one of said first and second stacking means includes a deck for stacking the sheet material.

21. An apparatus according to claim 16, further comprising warning means for producing a warning in response to signal produced by said first signal generating means.

* * * * *

UNITED STATES PATENT AND TRADEMARK OFFICE

CERTIFICATE OF CORRECTION

PATENT NO. : 5,028,041 Page 1 of 2

DATED : July 2, 1991

INVENTOR(S) : Kobayashi

It is certified that error appears in the above-identified patent and that said Letters Patent is hereby corrected as shown below:

SHEET 6,
Fig. 8, in Box 205 "uper" should read --upper--.

COLUMN 1,
Line 7, "Ser. No. 06/990,169," should read --Ser. No. 06/790,169,--.

COLUMN 2,
Line 58, "an" should --a--.

COLUMN 3,
Line 25, "is" should read --are--;
Line 63, " 1 " should read -- 2 --; and
Line 68, "are remained" should read --remaining--.

COLUMN 4,
Line 31, "cassette" should read --cassettes--.

COLUMN 5,
Line 54, "2B" should read --12B--; and
Line 63, "extend" should read --extent--.

COLUMN 6,
Line 54, delete "up".

COLUMN 8,
Line 7, delete "of";
Line 40, "amounts" should read --amount--; and
Line 41, "are" should read --is--.

UNITED STATES PATENT AND TRADEMARK OFFICE

CERTIFICATE OF CORRECTION

PATENT NO. : 5,028,041

DATED : July 2, 1991

INVENTOR(S) : Kobayashi

It is certified that error appears in the above-identified patent and that said Letters Patent is hereby corrected as shown below:

COLUMN 9,
Lines 38 and 41, "has" should read --have--.

COLUMN 10,
Line 53, "ana mount" should read --an amount--.

COLUMN 11,
Line 1, "claim 11," should read --claim 16,--.

Signed and Sealed this

Twenty-third Day of February, 1993

*Attest:*

STEPHEN G. KUNIN

*Attesting Officer*

*Acting Commissioner of Patents and Trademarks*